United States Patent [19]

Tsutsui et al.

[11] Patent Number: 4,808,087

[45] Date of Patent: Feb. 28, 1989

[54] CANNED MOTOR PUMP

[75] Inventors: Toshiaki Tsutsui; Takashi Akiba, both of Tokyo, Japan

[73] Assignee: Nikkiso Co., Ltd., Tokyo, Japan

[21] Appl. No.: 766,075

[22] Filed: Aug. 14, 1985

Related U.S. Application Data

[63] Continuation of Ser. No. 529,800, Sep. 6, 1983, abandoned.

[30] Foreign Application Priority Data

Sep. 28, 1982 [JP] Japan ..... 57-167581

[51] Int. Cl.[4] ..... F04B 17/00; F04B 39/02

[52] U.S. Cl. ..... 417/369; 417/372

[58] Field of Search ..... 417/370, 369, 366, 371, 417/372

[56] References Cited

U.S. PATENT DOCUMENTS

| | | | |
|---|---|---|---|
| 2,595,730 | 5/1952 | Swiss et al. | 100/DIG. 3 |
| 2,939,399 | 6/1960 | Rutschi | 417/370 |
| 3,057,741 | 10/1962 | Moore | 106/DIG. 3 |
| 3,163,790 | 12/1964 | White | 417/366 |
| 3,220,349 | 11/1965 | White | 417/370 |
| 3,637,329 | 1/1972 | Sato et al. | 417/368 |

FOREIGN PATENT DOCUMENTS

| | | | |
|---|---|---|---|
| 496115 | 11/1938 | United Kingdom | 417/370 |

*Primary Examiner*—Cornelius J. Husar
*Assistant Examiner*—Peter M. Cuomo
*Attorney, Agent, or Firm*—Helfgott & Karas

[57] ABSTRACT

A canned motor pump having improved dielectric strength at a high temperature above 200° C. is disclosed in which a jacket is arranged on an outer wall of the canned motor section, to an inlet port of which jacket is supplied a portion of pressurized liquid to be treated, while an outlet port of said jacket is connected to a lower pressure zone of the pump section or pump tubing system to circulate the liquid thereto. In accordance with the canned motor pump, the efficient cooling of the canned motor and the economically advantageous pump system without energy loss may be achieved.

11 Claims, 4 Drawing Sheets

CANNED MOTOR PUMP

This is a continuation application of Ser. No. 529,800 filed Sept. 6, 1983 now abandoned.

FIELD OF THE INVENTION

This invention relates to a canned motor pump for treating a high temperature liquid.

BACKGROUND OF THE INVENTION

Usually, a canned motor pump allows a portion of a treating liquid to circulate within a rotor chamber of a canned motor section for cooling the motor section and for lubricating its bearings. In the canned motor pump utilizing a canned motor of H or C type insulation which is poor in heat resistance, however, direct cooling of the canned motor section with a treating liquid is difficult for the hot treating liquid above 200° C. In such case, the motor section is provided at its outer wall with a jacket for water-cooling in order to protect the canned motor section.

Generally, the heat resistance of the conventional motor of C type insulation is limited to 220° C. at highest and thus a temperature of the liquid to be introduced into such canned motor must be controlled about scores of degrees below the limited temperature. For this reason, the conventional canned motor pump for treating the hot liquid above 180° C. is usually of a water-cooling type, as illustrated in FIG. 1.

Namely, the canned motor pump in FIG. 1 comprises a pump section 10 and a motor section 12 thermally separated from each other by anadapter 14 which is provided with a pressure balancing hole 18 for preventing cavitation of an auxiliary impeller 16. Thus, a space pressurized by a main impeller is communicated with a rotor chamber 22 for its pressurization. In this case, small size of the pressure balancing hole 18 allows only a small amount of liquid to flow from the pump section 10 to the motor section 12. In order to cool the motor and to lubricate its bearings, a stator assembly 24 is provided at its outer wall with a heat exchanger 26 to which is circulated the liquid of the motor section 12 by means of the auxiliary impeller 16 provided within the rotor chamber 22. Thus, circulation of the liquid in the motor section 12 is carried out as follows: the liquid pressurized by the auxiliary impeller 16 is introduced through a first circulation tube 28 into an inner pipe 30 of the heat exchanger 26 where the liquid is cooled by a cooling water, and then is introduced through a second circulation tube 32 and a rear bearing housing 34 into the rotor chamber 22 while lubricating a rear bearing 36. Then, the liquid flows through a gap between a stator can 38 of the stator assembly 24 and a rotor can 42 of a rotor assembly 40 for cooling the motor. The liquid, on cooling the motor has its temperature increased a few degrees, lubricates a front bearing 44 and then returns to a suction part of the auxiliary impeller 16, thereby to repeat the circulation. The cooling water introduced into the heat exchanger 26 allows the circulated liquid through the circulation tubes 28, 32 to be cooled and further the motor to be cooled through the outer wall of the stator assembly 24 as a heat transfer surface.

In such type of the conventional canned motor pump a considerable loss of heat, such as exotherm of the motor and heat of the treating liquid, is caused by the cooling water. Further, the heat exchanger and its tubings, as well as accompanying equipments for feeding and discharging the cooling water and for alarming water stoppage may constitute an enormous and complicated apparatus and thus require strict maintenance for preventing corrosion and scaling of the apparatus due to the cooling water, resulting in a considerable increase in an initial investment and a maintenance cost.

In order to solve the problems associated with the conventional canned motor pump as described hereinabove, it is necessary to improve the heat resistance of the canned motor or motor components, and more importantly to increase the dielectric strength of its winding at a high temperature. The conventional canned motor of a general construction may be thermally deteriorated in its winding and insulation at a high temperature above 200° C., thereby to reduce its mechanical strength with consequent damage the insulation.

In view of the foregoing, the applicant has already developed and proposed a canned motor pump having satisfactory dielectric strength at temperatures above 300° C., in which a synthetic fluoro-mica with an organic solvent is suspended in an organosilicon compound solvent for impregnation and curing thereby to form an insulation for windings, in which insulation a fluoro compound vaporized from the fluoro mica is combined with siloxane from the organosilicon compound at the high temperature above 200° C. to form a ceramic-like material for improving the mechanical strength and the dielectric strength of the windings, such as a field winding.

According to such canned motor pump for use in an atmosphere of the high temperature, the canned motor having improved heat resistance is connected to the pump section through an adapter for thermally separating the motor section and a portion of the treating liquid of high temperature is circulated into the canned motor section through an outer tubing for recovering the exotherm of the motor in the liquid, thereby to achieve a lower operation cost as well as savings of resources and energy through the simple construction.

With such type of the canned motor pump for the high temperature, however, the stator assembly of the motor section at its outer circumference is exposed to the atmosphere, so that a portion of generated heat from the motor may be dissipated into the atmosphere through the circumference as a heat transfer surface, resulting in a considerable loss of heat and energy, leading to an economical disadvantage.

It has now been found out that the canned motor pump of a simple construction, which may solve the problems of the conventional canned motor pump and improve the energy saving effect through efficient recovery of the generated heat from the motor, may be achieved by providing a jacket on the outer wall of the motor section, introducing a portion of the treating liquid pressure in the motor section into said jacket for completely absorbing the generated heat of the motor into said portion of the liquid and circulating the liquid to a suction side of the pump section or a lower pressure zone of the pump tubing system.

SUMMARY OF THE INVENTION

A general object of the invention is to provide a canned motor pump, which employs a canned motor of excellent heat resistance to more than 300° C. and may achieve smooth operation of a pump by completely absorbing and recovering the generated heat from the canned motor into the treating liquid for cooling the canned motor, thereby to alleviate heat load of a heating source for the treating liquid and to contribute to savings of resources and energy, leading to an economical advantage.

A principal object of the invention is to provide a canned motor pump comprising a canned motor section and a pump section having improved dielectric strength at a high temperature above 200° C., in which a jacket is arranged on an outer wall of the canned motor section, to an inlet port of which jacket is supplied a portion of pressurized liquid to be treated, while an outlet port of the jacket is connected to a lower pressure zone of the pump section or pump tubing system for circulating the liquid thereto. Thus, the jacket serves as means not only for cooling the motor but also for recovering heat of the motor positively and efficiently.

In the canned motor pump, the jacket is preferably mounted on the outer wall for completely surrounding an inner core of a stator assembly.

Further, it is preferred that a line communicating with the inlet port of the jacket is connected to a part of a delivery tube of the pump section, while a line leaving the outlet port of the jacket is connected to a part of a suction tube of the pump section.

Alternatively, the inlet port of the jacket may be communicated with an opening arranged in a rear side of the outer wall of the pump section via a feeding line formed on the outer wall of the canned motor section, while the outlet port of the jacket may be communicated with the lower pressure zone of the pump section via a discharging line formed on the outer wall of the canned motor section. Thus, each line to the jacket may be integrated on the outer circumference of the canned motor section, thereby to eliminate any exterior tubing and to facilitate heat-retention and maintenance of the pump section.

In the latter case, it is preferred that the feeding line is arranged on the outer wall of a bottom part of the canned motor section while the discharging line is arranged on the outer wall of a top part of the canned motor section, and that a junction between the canned motor section and the pump section is communicated with a circulation line of the treating liquid which circulates within the canned motor.

Further, the canned motor section preferably allows a peripheral portion of an impeller to communicate with a front rotor chamber of the pump section, while a rear rotor chamber may be communicated with a rear side of the impeller of the pump section via an inner tube provided in a rotor shaft for forming the circulation line.

In addition, the pump and the canned motor sections are preferably connected by means of an adapter provided with a flowing line communicating with each other in order to facilitate assembly and disassembling the canned motor pump.

In the canned motor pump according to the invention, the canned motor section may be formed by impregating a field winding with an insulating and impregnating agent consisted of a special silicone filled with fluoro-mica followed by curing.

The invention will be described in more detail for the preferred embodiments with reference to the accompanying drawings.

PREFERRED EMBODIMENTS OF THE INVENTION

Figure 1:
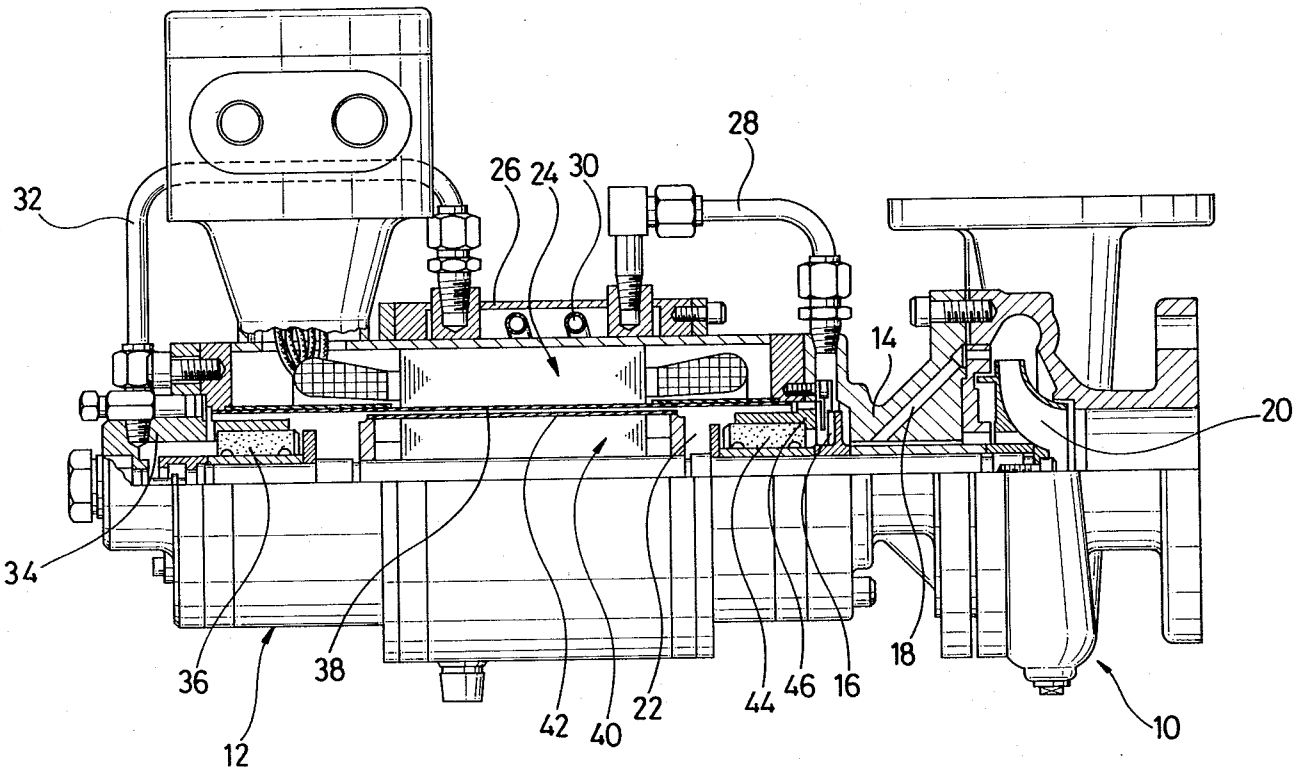
FIG. 1 is a cross-sectional side view of a main portion of the conventional canned motor pump.
Figure 2:
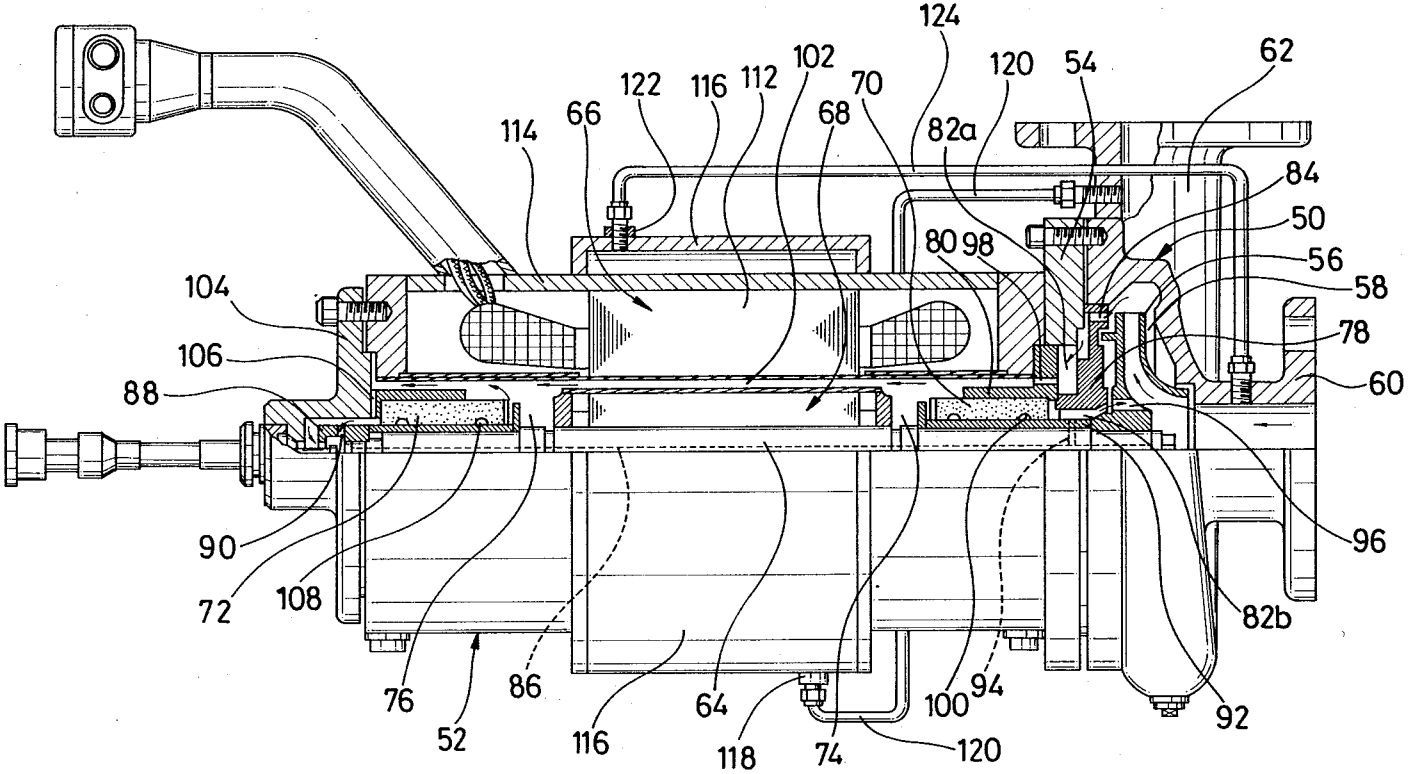
FIG. 2 is a cross-sectional side view of a main portion of the canned motor pump according to the invention.

Referring to the canned motor pump of FIG. 2, a pump section 50 and a canned motor 52 are connected by means of an adapter 54.

The pump section 50 is provided with a suction tube 60 and a delivery tube 62 each communicating with a pump chamber 58 containing an impeller 56 therein. The impeller 56 is mounted to an extension of a rotor shaft 64 in the motor section 52. On the other hand, the motor section 52 comprises a stator assembly 66 and a rotor assembly 68, in which the rotor shaft 64 is supported by a front and a rear bearings 70 and 72, respectively for forming a front and a rear rotor chambers 74 and 76 at either end of the rotor assembly 68.

At a junction between the pump section 50 and the adapter 54 is arranged a liner disc 78, an end of which at its rotor shaft side is extended to be fitted into a bearing support 80 for forming liquid passages **82*a*, 82*b* divided by the adapter 54. The liner disc 78 at its peripheral position in the impeller side is provded with a hole 84 which is communicated with the one passage 82*a*. The rotor shaft 64 is axially extended for forming an inner conduit 86 which is communicated with the rear rotor chamber 76 through a hole 90 of an end nut 88 provided at a rear end of the rotor shaft 64. On the other hand, the inner conduit 86 is communicated with the other passage 82*b* of the adapter 54 through a hole 94 of a spacer 92 provided at a front end of the rotor shaft 64. The passage 82*b* is communicated with a lower pressure zone of the pump section 50 or with a suction side of the impeller 56 through a pressure balancing hole 96** provided therein.

Thus, the bearing support 80 having a front bearing 70 is provided with a hole 98 for introducing a portion of a treating liquid from the pump section 50 into the front rotor chamber 74, an inner surface of which in turn is provided with a hole 100 for introducing said portion of the liquid for lubrication. In order to introduce the liquid into the rear rotor chamber 76 through a gap 102 between the rotor and the stator, a bearing support 104 for the rear bearing 74 is provided with a hole 106 which is communicated with the hole 90 connecting to the inner conduit 86 of the rotor shaft 64. The rear bearing 72 at its inner circumference is also provided with a hole 108 for introducing the liquid for lubrication.

In order to increase dielectric strength of the canned motor at a high temperature, its field winding is strengthened in insulation. Namely, for the copper wire used for the conductive winding there is employed a glass coating, which is applied by first the surface of the wire with nickel for preventing thermal oxidation followed by application of a glass insulation coating thereon. An aggregated mica plate with an inorganic adhesive is used for a wedge, while an aggregated mica with a limited quantity of a special silicone adhesive is used for a flexible insulation sheet. As an insulating and impregnating agent for the winding and as an end molding material there is used a material which has been prepared by suspending small pieces of synthetic fluoro-mica in size of ≦5 μm thickness and 0.1–5 μm diameter into an organosilicon solvent in a ratio by weight of 1:1 together with a mixed organic solvent, such as xylene, butylcellosolve and cellosolve acetate. The impregnated winding is then cured.

If the field winding is insulated in this way, the insulation allows a fluoro compound, such as $SiF_4$ and KF, to be volatilized from the synthetic fluoro-mica at a temperature above 200° C., which fluoro compound is then reacted with siloxane from the organosilicon compound to form a ceramic-like substance thereby to increase the mechanical and dielectric strength of the winding.

The canned motor thus constructed has a sufficient dielectric strength to operate even in at temperatures above 300° C.

In accordance with the canned motor pump of the invention, the stator 66 at its iron core 112 is surrounded with an outer wall 114, on which is arranged a jacket 116. An inlet port 118 of the jacket 116 is communicated with a tubing 120 leaving from the delivery tube 62 of the pump section 50, while an outlet port 122 of the jacket 116 is communicated with a tubing 124 leaving from the suction tube 60 of the pump section 50.

Thus, the generated heat dissipated from the iron core 112 of the stator 66 outward through the outer wall 114 or a heat transfer surface may be absorbed into the treating liquid pressurized in the pump section 50 for elevating the temperature of the liquid, which is then returned to the suction side of the pump.

Within the canned motor 52, the liquid is introduced from the rear side of the impeller 56 into the front rotor chamber 74 via the hole 84 of the liner disc 78, the passage **82*a* and the hole 98 of the bearing support 80. Then, a portion of the liquid in the front rotor chamber 74 is circulated to the lower pressure side of the pump section 50 through the hole 100, the passage 82*b* and the hole 96 of the impeller 56 in order to lubricate the front bearing 70. A main portion of the liquid in the front rotor chamber 74 flows through the gap 102 between the rotor and the stator into the rear rotor chamber 76 for absorbing the generated heat of the motor. Then, the portion of the liquid in the rear rotor chamber 76 is circulated through the hole 108 for lubricating the rear bearing 72. Thus, the liquid, which has elevated its temperature, in the rear rotor chamber 76 is circulated to the lower pressure side of the pump section 50 via the hole 106 of the bearing support 104, the hole 90 of the end nut 88, the inner conduit 86 of the rotor shaft 64, the hole 94 of the spacer 92, passage 82*b* and the balancing hole 96 of the impeller 56**.

With the canned motor pump according to the embodiment as described hereinabove, the generated heat inside and outside the motor section 52 may be completely absorbed into the treating liquid which in turn may be recovered in the pump section, so that the canned motor may be efficiently cooled without energy loss, resulting in an extremely economical pump system.

Figure 3:
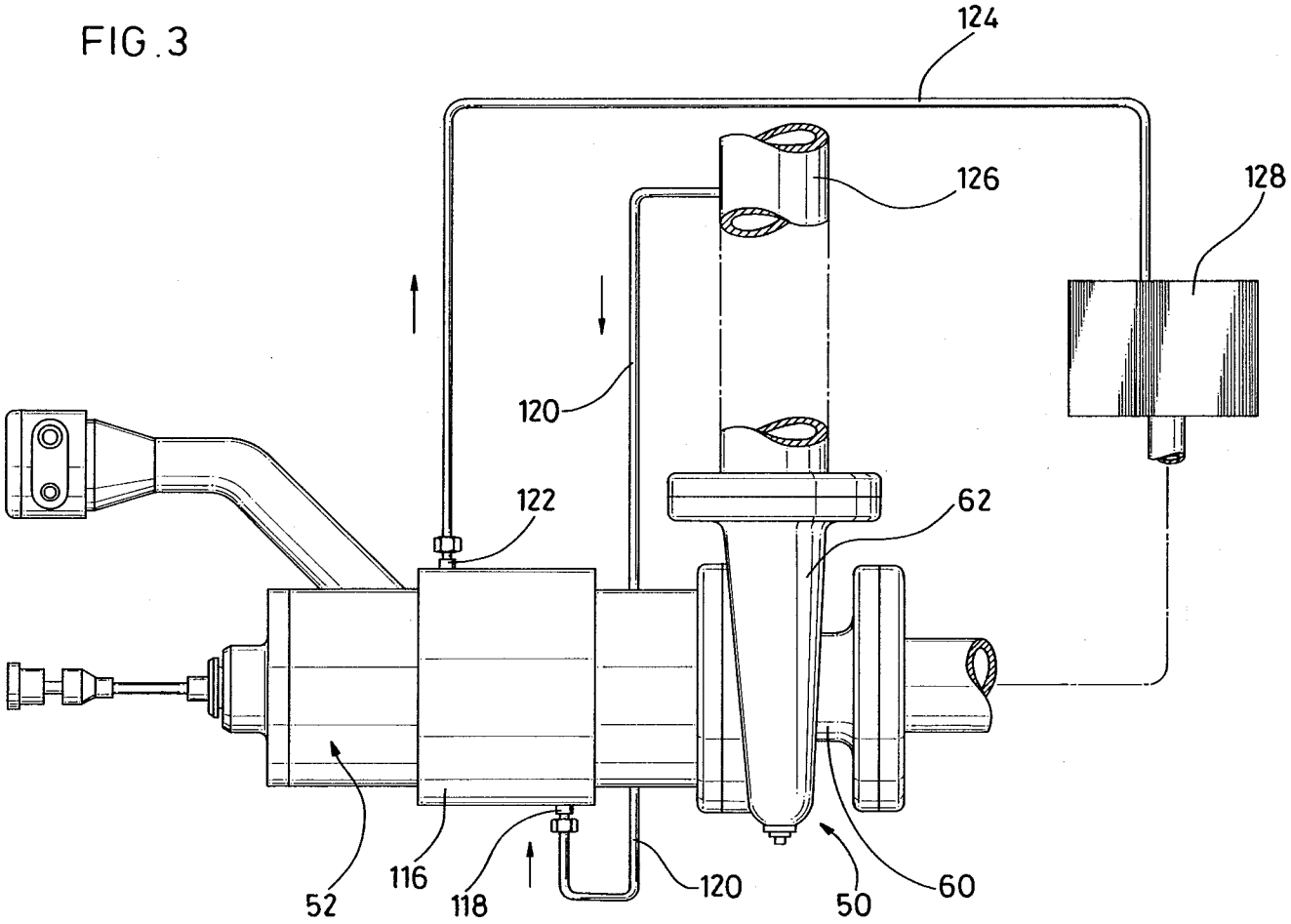
FIG. 3 shows a tubing system of a variation of the canned motor pump in FIG. 2.

Further, according to this embodiment, as the means for supplying the treating liquid to the jacket 116 and for circulating the same to the pump system, there may be arranged a tubing 120 extending from a delivery tube 126 of the pump section 50 and communicating with an inlet port 118, as shown in FIG. 3. A tubing 124 extending from an outlet port 122 of the jacket 116 is used as a tubing system connected to the suction tube 60 of the pump section 50 and is communicated with a liquid supplying tank 128, as shown in FIG. 3.

Figure 4:
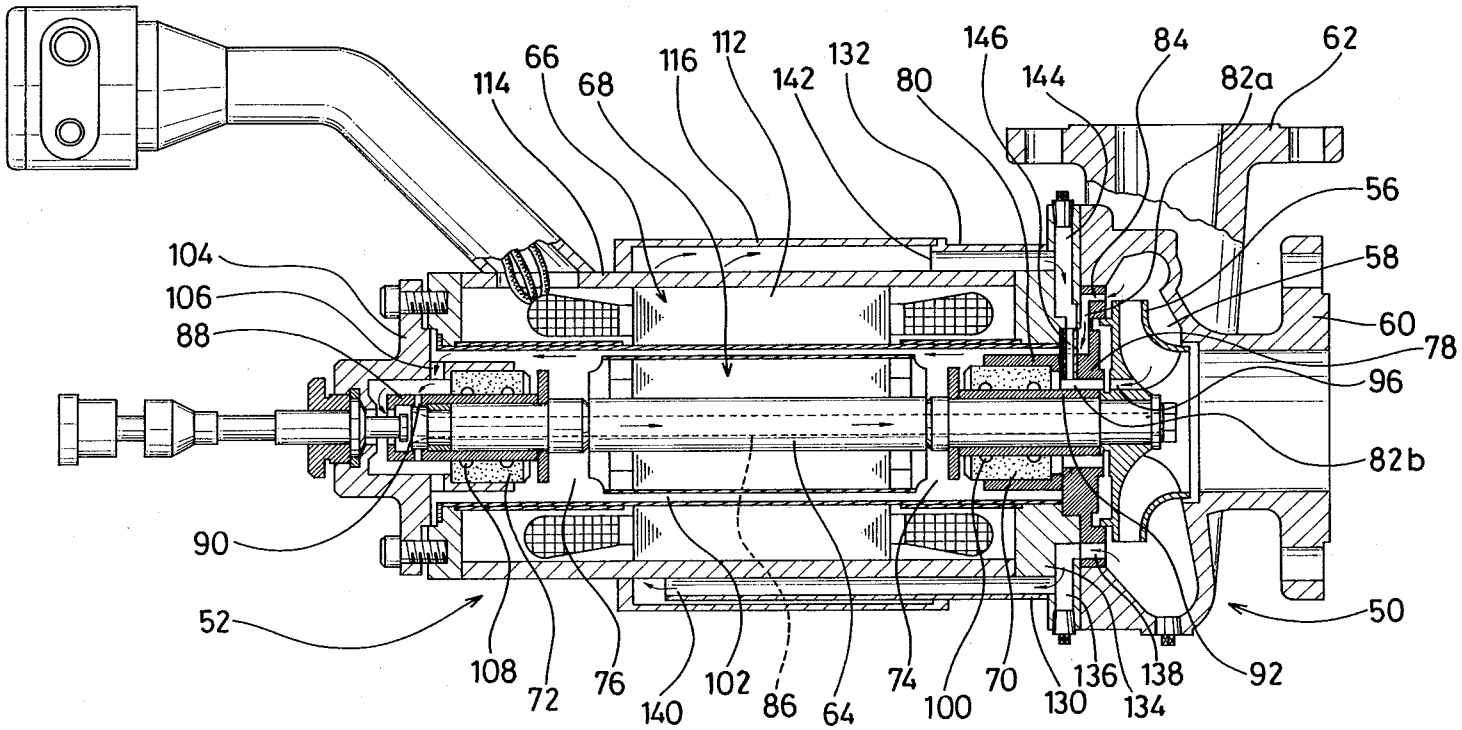
FIG. 4 is a cross-sectional side view of a main portion of another variation of the canned motor pump according to the invention.

FIG. 4 is a sectional view of a main portion of another embodiment of the canned motor pump according to the invention. For simplification, the same numerical references will be used for the same components as in the embodiment of FIG. 2 and the description for these components will be omitted.

In the embodiment of FIG. 4, the pump section 50 and the canned motor section 52 are interchangeably connected with the liner disc 78 but other construction is substantially identical to the embodiment of FIG. 2. The jacket 116, which is arranged on the outer wall 114 surrounding the iron core 112 of the stator assembly 66, is integrally provided with a feeding line 130 and a discharging line 132 on the outer circumference of the canned motor section, through which lines is communicated the pump chamber 58 of the pump section 50 with the jacket 116.

The feeding line 130 is communicated at its one end with an opening 138 in the liner disc 78 located in the bottom side of the pump chamber 58 via a hole 136 in a front end bell 134 of the canned motor section 52 and at its other end is communicated with a lower portion of the jacket 116 to form a feeding port 140. On the other hand, the discharging line 132 is communicated at its one end with an opening 142 located in the front top side of the jacket 116 and at its other end with the feeding line **82*b* between the liner disc 78 and the spacer 92 via a hole 144 in the front end bell 134. In this case, the hole 144 allows the feeding line 82*a* to be solid-crossed through a feeding line 146, wherein the pump chamber 58 is communicated with the inside of the canned motor section 52 through the feeding line 82*a*. Thus, the hole 144 is communicated with the lower pressure side of the pump section 50, namely with the suction side of the impeller 56 via its balancing hole 96**.

Thus, the generated heat dissipated outward through the outer wall 114 from the iron core 112 of the stator assembly 66 is absorbed in the treating liquid, which has been pressurized in the pump section 50, to be introduced into the jacket 116 in order to elevate the temperature of the liquid. Then, the liquid of the elevated temperature is returned to the suction side of the pump.

In the canned motor section 52, on the other hand, similarly to the canned motor pump as shown in FIG. 2, the portion of the treating liquid received in the pump section 50 is introduced into the front rotor chamber 74 from the outer back periphery of the impeller 56 through the hole 84 of the liner disc 78 and the feeding line **82*a*. Then, the portion of the liquid is circulated to the lower pressure side of the pump section 50 through the hole 100, the feeding line 82*b* and the balancing hole 96 of the impeller 56 in order to lubricate the front bearing 70. Major portion of the treating liquid received in the front rotor chamber 74 is guided into the rear rotor chamber 76 through the gap 102 between the rotor and the stator for absorbing the generated heat from the motor. Then, the portion received in the rear rotor chamber 76 is circulated to the hole 108 for lubricating the rear bearing 72. In this way, the treating liquid of elevated temperature in the rear rotor chamber 76 is circulated to the lower pressure side of the pump section 50 via the hole 106 of the bearing support 104, the hole 90 of the end nut 88 and the inner conduit 86 of the rotor shaft 64**.

Also in this embodiment of the canned pump, the heat generated inside and outside of the motor section 52 may be absorbed in the treating liquid and recovered in the pump system, so that the efficient cooling of the canned motor and the economical pump system without energy loss may be achieved.

Especially in this embodiment of the canned motor pump, the feeding and the discharging lines of the jacket for recovering the generated heat from the motor are formed integrally with the motor and the pump sections, so that the outer tubings may be eliminated for simplification of the outer construction and that the convenient heat retention of the motor and the outer wall of the jacket, as well as the convenient maintenance of the pump section may be achieved.

As apparatent from the embodiments described hereinabove, the canned motor pump according to the invention, when used for treating a liquid of high temperature, may absorb the entire heat generated from the motor, so that the economically advantageous liquid-feeding system may be achieved without any energy loss and with extremely lower thermal load of the heating source, such as a boiler or a heater.

Although the preferred embodiments of the invention have been described hereinabove, the invention may be varied and modified in many ways without departing from the scope and the spirit of the invention. For example, although the horizontal arrangement of the canned motor pumps has been described hereinabove, the vertical arrangement thereof may be readily employed only by varying and modifying the adapter for connecting the pump section to the canned motor section.

What is claimed is:

1. A canned motor pump for absorbing heat into a treating liquid which is generated within and in an electric motor of the canned motor pump having an improved dielectric strength at temperatures of above 200° C. and comprising a canned electric motor having a cylindrical housing, said motor driving an impeller pump having an impeller housing said impeller housing having a low pressure inlet and a high pressure outlet for discharging a high pressure treating liquid, said motor comprising of an inner rotor and an outer, annular which are both mounted within the cylindrical housing to define a gap therebetween, at least said stator having an iron core, fluid passage means for communicating a first portion of the high pressure treating liquid at a first pressure from a fluid chamber located on a rear side of the impeller to and through said gap between said rotor and said stator, in order to inhibit heat dissipation into the atmosphere from the cylindrical outer housing of the motor an outer surface of the iron core of the stator directly engages an inner surface of the cylindrical housing an outer surface of the cylindrical housing being directly engaged and surrounded about its entire circumference by a hollow jacket member having an inlet supplied with a second portion of the high pressure treating liquid at a second pressure, from the high pressure outlet of the pump, said jacket member having an outlet communicating with the low pressure inlet of the pump and thereby providing two liquid circulation systems in a single pump and motor arrangement whereby heat in the second portion of the treating liquid from the jacket outlet together with the heat in the first portion are recovered in the pump.

2. The canned motor pump of claim 1, wherein the said second pressure is higher than said first pressure.

3. A canned motor pump according to claim 1, wherein said inlet of the jacket communicates with an opening in a rear side of an outer wall of the pump section via an inlet fluid passage formed on the outer surface of the canned motor section, said outlet of the jacket being communicated with the low pressure inlet of said pump via a discharge fluid passage formed on the outer surface of the canned motor

4. The canned motor pump according to claim 3, wherein said inlet fluid passage is on the outer surface of a bottom portion of the canned motor while said discharge fluid passage is on the outer surface of the top portion of the canned motor, a disc member between the canned motor and the pump section being in communication with a circulation flow of the treating liquid which circulates within the canned motor.

5. The canned motor pump of claim 1, wherein said canned motor section has a rotor iron core, said gap being between said stator iron core and said rotor iron core.

6. A canned motor pump according to claim 1, wherein the inlet of the jacket communicates with an opening arranged in a rear side of an outer wall of the pump via an inlet fluid passage formed on the outer surface of the canned motor, while the outlet of the jacket communicates with the lower pressure inlet of the pump via a discharge fluid passage formed on the outer surface of the canned motor.

7. A canned motor pump according to claim 6, wherein the inlet fluid passage is arranged on the outer surface of a bottom portion of the canned motor while the discharge fluid passage is arranged on the outer surface of a top portion of the canned motor, and wherein a disc member between the canned motor and the pump being in communication with a circulation flow of the treating liquid which circulates within the canned motor.

8. A canned motor pump according to claim 1, wherein the pump and the canned motor are connected by means of an adapter provided with passage means for passing said first portion of the treating liquid from said rear side of the impeller to said gap.

9. A canned motor pump according to claim 1, wherein the canned motor has a front rotor chamber which is in fluid communication with said rear side of the impeller of the pump, said front rotor chamber communicating with said gap which in turn communicates with a rear rotor chamber of the motor in turn communicating with an inner duct provided in a shaft of the rotor for forming a circulation path for the treating liquid.

10. A canned motor pump according to claim 6, wherein the canned motor communicates a peripheral chamber about the impeller with a front rotor chamber, said front rotor chamber communicates with a rear side of the impeller of the pump via an inner duct provided in a rotor shaft for forming the circulation path for the treating liquid.

11. A canned motor pump according to claim 7, wherein the canned motor communicates a peripheral chamber about the impeller with a front rotor chamber, said front rotor chamber communicates with a rear side of the impeller of the pump via an inner duct provided in a rotor shaft for forming the circulation path for the treating liquid.

* * * * *